United States Patent [19]

Hough et al.

[11] 4,272,465

[45] Jun. 9, 1981

[54] METHOD FOR MULTI-STORIED CONCRETE CONSTRUCTION AND APPARATUS THEREFOR

[76] Inventors: Reginald D. Hough; Vincent J. Kelly, both of 15 Green St., Huntington, N.Y. 11743

[21] Appl. No.: 37,296

[22] Filed: May 9, 1979

[51] Int. Cl.[3] ..... E04B 1/16

[52] U.S. Cl. ..... 264/33; 249/20; 264/34

[58] Field of Search ..... 264/33, 34; 249/34, 249/177, 20

[56] References Cited

U.S. PATENT DOCUMENTS

| | | | |
|---|---|---|---|
| 2,093,401 | 9/1937 | Carilli | 249/30 |
| 2,773,512 | 12/1956 | Burk | 264/34 |
| 2,964,821 | 12/1960 | Meehan | 264/34 |
| 3,252,199 | 5/1966 | Bosner | 264/34 |
| 3,482,005 | 12/1969 | Quentin | 264/34 |
| 3,804,930 | 4/1974 | Dashew | 249/177 |
| 3,818,084 | 6/1974 | Tamburini | 264/33 |
| 3,959,423 | 5/1976 | Boyd | 264/34 |
| 3,993,720 | 11/1976 | Burdett | 264/33 |

*Primary Examiner*—John Parrish

*Attorney, Agent, or Firm*—Pennie & Edmonds

[57] ABSTRACT

A method for casting multiple floor beams including the steps of assembling a multiplicity of spaced pan form units where the space between adjacent pan units forms the side of a beam form. A bottom panel is positioned between adjacent pan units to form the bottom of the beam form. The pan units are then locked together on their underneath sides to form an integral pan deck. Reinforcing framework is added into the beam forms and the pan form units are then locked together on their top sides. Concrete is then cast into the beam forms to form beams of a first floor level after which the underneath sides of the pan form units are unlocked and the bottom panel removed. The integral pan unit is then raised by jack means to a second floor level. During the time that the integral pan deck is being raised or after it is raised, the bottom panel is repositioned and the panels are again locked together on their underneath sides. The assembly is then in position in which the steps may be repeated.

A form for multiple floor concrete construction which includes a plurality of spaced pan units where the units have sloping sides to form the sides of a beam form having negative draft. Removable bottom panels are provided to form the bottom of a pan unit. Locking means are provided on the top and underneath sides of the pan units by which the pan units may be locked together to form an integral pan deck. Jacking means are included to raise the integral pan deck from a first floor position to a second floor position.

6 Claims, 4 Drawing Figures

FIG. 3
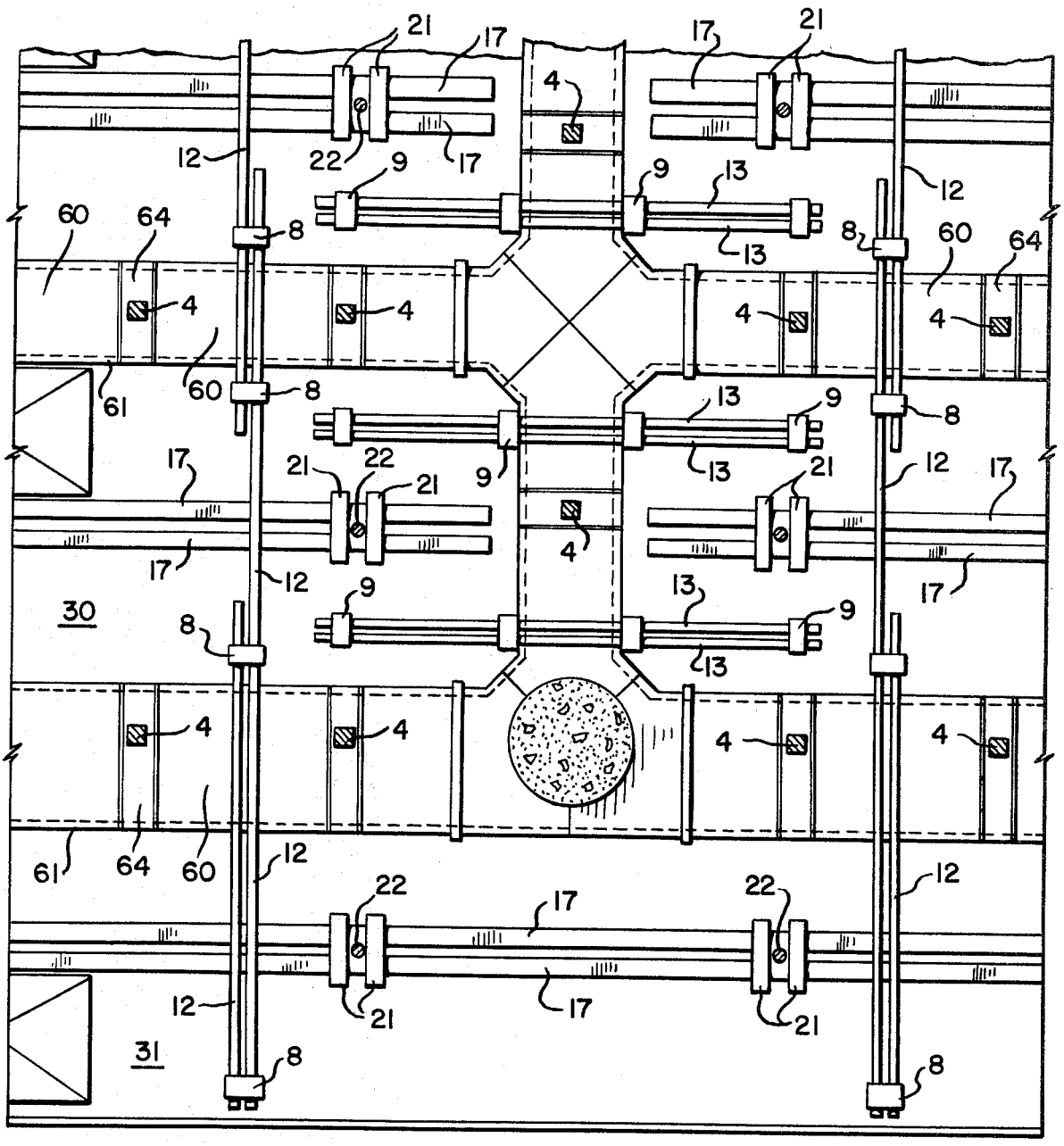
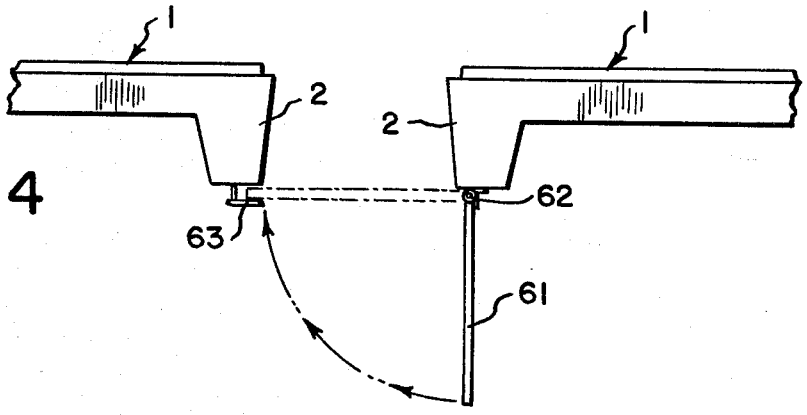
FIG. 4

METHOD FOR MULTI-STORIED CONCRETE CONSTRUCTION AND APPARATUS THEREFOR

FIELD OF THE INVENTION

The invention relates to a method and structure for constructing multi-floor concrete buildings.

BACKGROUND OF THE INVENTION

Conventional multi-floor concrete construction in the past has required that framework supporting the floor forms in which the concrete is cast be assembled for each floor. After the concrete is cast in the forms, the forms and the framework supporting the forms are then disassembled and reconstructed on a higher floor. Such assembly and disassembly necessarily is labor-intensive, time-consuming and requires that the form and supporting framework be raised in disassembled pieces either at the sides of the building or through shaft openings in the floors.

Various methods of construction have been proposed in an attempt to reduce the expense and time required in assembling and disassembling forms. One method proposed has been to utilize forms which rest upon a fixed framework which provides a support for concrete poured to form a floor and where, after the concrete has set, the framework and forms are lowered and moved laterally to the side of the floor where the framework is then "flown" to an upper floor utilizing conventional cranes positioned at the side of the building. Such construction requires sufficient lateral space in which to raise the forms as well as to position the cranes used to raise the forms. Examples of such methods of construction are shown in U.S. Pat. 3,787,020 and 3,977,536.

It is an object of our invention to provide for a method of construction and for a movable form structure by which a multi-floor concrete construction may be erected utilizing a minimum of labor and time for moving the forms from one floor position to a second floor position. A further object of our invention is to provide for a method and structure which will eliminate need of lateral space at the side of a floor in which to swing and raise assembled forms such as disclosed in the aforementioned patents.

GENERAL DESCRIPTION OF THE INVENTION

Broadly we propose to provide a method and structure by which concrete floor beams may be cast in vertically spaced floor levels and on which floor slabs overlying the beams may be added after the beams have hardened and become load supporting. The method comprises generally assembling a plurality of pan form units together at a first floor level where the form units are horizontally spaced with the facing sides of adjacent pan units defining vertically extending sides of a beam form. A removable bottom panel is positioned between the adjacent pan form units in order to define the bottom of a beam form. The pan form units are then connected together on their underneath sides by a plurality of horizontally extending joists which lock with clamping units on the underside of the pan units to form an integral pan deck. Reinforcing framework is then added to the beam forms after which concrete is cast into the forms. The pan units are then locked together by horizontally extending top joists engaging clamping means on the top sides of the pan units after which the bottom joists are removed.

The integral pan deck is then raised by jack means after the concrete has hardened to a second floor position. During the raising step or after, the bottom joists are again clamped to the underneath sides of the pans after which the top joists are unclamped and removed from the top sides of the pans. The sides of the pans have a negative draft in order that they may easily break away from the cast beams when the pan deck is raised.

After the structural frame has been cast, forms are positioned in the voids between the hardened beams and a floor slab poured over the forms and beams to complete the floor.

In one form of the invention the bottom panels which are supported by shoring remain in place to provide support for the cast beams. In a further form of the invention, the bottom panels are segmented with shore portions being positioned between the segments which contact with shores and remain in place to support the beams until they have hardened sufficiently to become load bearing.

A further feature of our invention involves utilizing a column form where a column is cast at the same time as the beams. The column form comprises a cardboard tube held in place by framework anchored to the pan deck.

BRIEF DESCRIPTION OF THE DRAWINGS

FIG. 3 is a view looking upwards towards the underneath side of the integral pan deck of FIG. 1; and FIG. 4 is an enlarged sectional view of a modified form of the invention illustrating positioning of a bottom panel with adjacent pans.

DETAILED DESCRIPTION OF THE INVENTION

Figure 1:
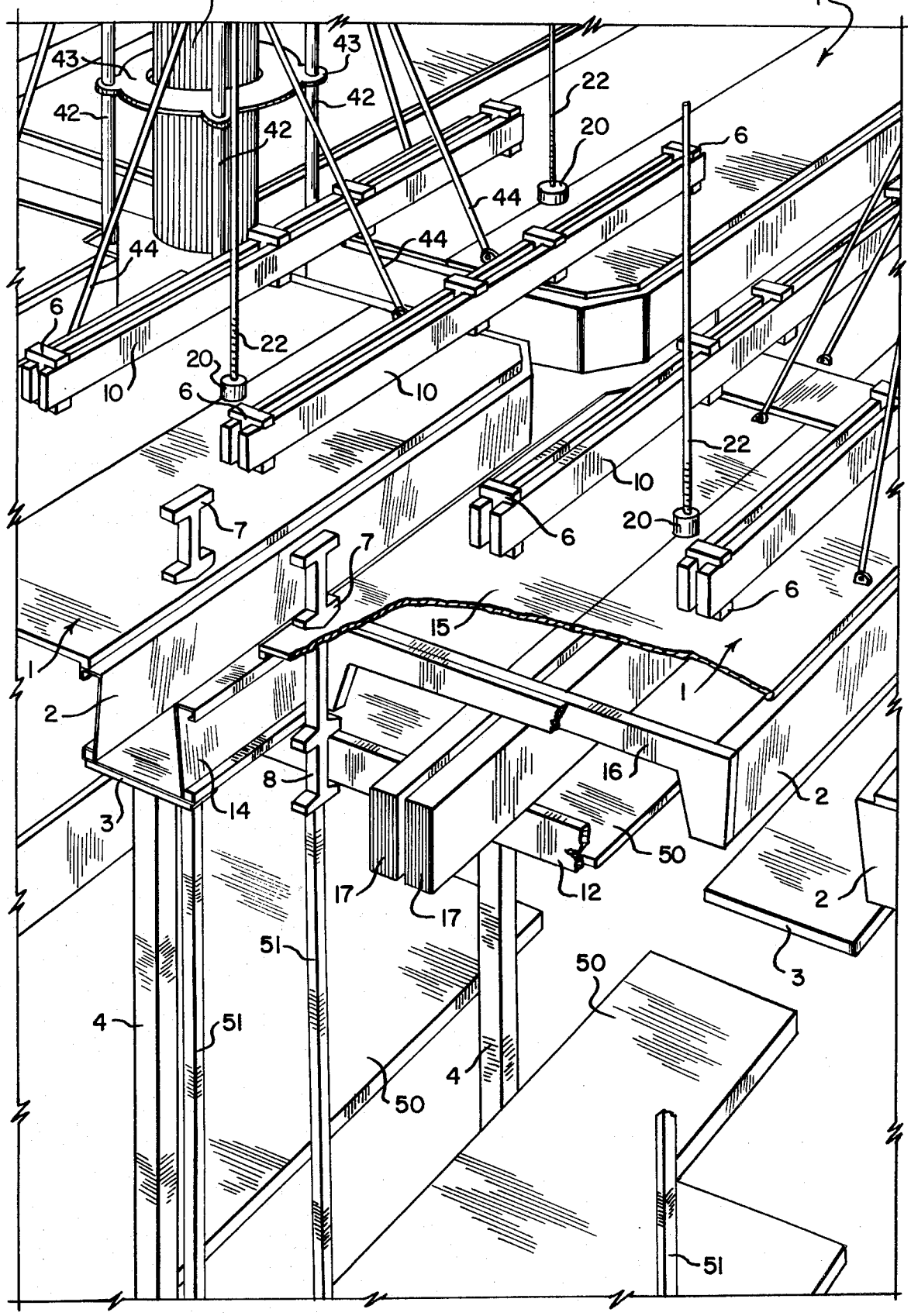
FIG. 1 is a diagrammatical perspective view of an integral pan deck with reinforcing framework removed from the beam forms.

Referring to FIG. 1 there is illustrated a multiplicity of pan units 1 which are horizontally spaced with respect to each other and where the sides 2 of the pan units define vertically extending sides of a beam form having inverted draft. A bottom panel 3 provides a bottom for each beam form and is supported by means of shores 4 which in turn rest upon beams shown in FIG. 2 which have been previously cast at a lower floor level. For purposes of clarity, reinforcing framework added to the forms is not illustrated in FIG. 1, it being understood however that when the pan units are in the position shown in FIG. 1 and the bottom panels have been shored, that the reinforcing framework may have already been placed in the forms.

Figure 2:
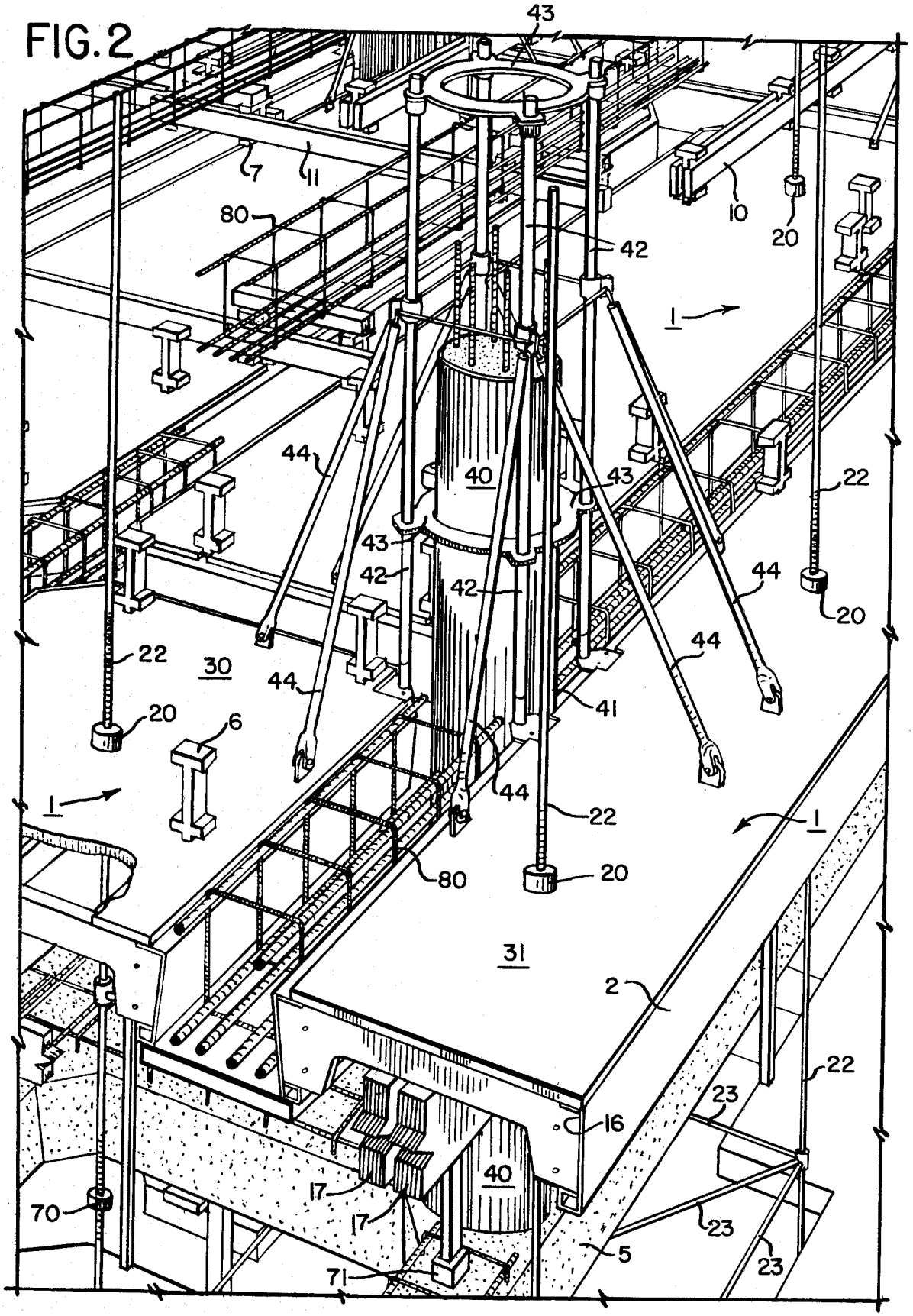
FIG. 2 is a diagrammatical perspective view of a pan deck similar to FIG. 1 illustrating a lateral end of the deck, details of a column form and with reinforcing framework in the beam forms prior to concrete being cast therein.

The pan units 1 have upper clamping means or top joist holders 6 and 7 and are connected to the top sides of the pan units and lower clamping means or bottom joist holders 8 and 9 which are connected to the underneath sides of the pan units. As shown in FIGS. 1, 2 and 3, the upper and lower clamping means preferably comprise bracket members which extend through the pan units and which are adapted to engage horizontally extending upper joists 10 and 11 and horizontally extending lower joists 12 and 13 to lock adjacent pan units together to form an integral pan deck. As shown in FIG. 1, the horizontally extending top joists 10 engage with the clamping means 6 and joists 11, shown in FIG. 3, extend at right angles thereto and engage with clamping means 7 to lock the pan units together into an integral pan deck. Similarly bottom joists 12 and 13 shown in FIG. 3 extend at right angles to each other and engage with the bottom clamping means 8 and 9 to also lock the pan units together into an integral pan deck. The bottom clamping means 8 and 9 extend below the pan units a sufficient distance that the bottom joists when engaged with the clamping means will also engage and support the bottom panels 3.

Each pan unit comprises sections 14 which form the vertically extending sides of the beam forms where the sections are inclined to give a negative draft so allowing the beam form to be pulled away from a cast beam when the form is raised with respect to the beam. The sections 14 are joined by decking 15 such that the decking may provide a working surface. Cross-members 16 connect the steel sections of a single pan unit and flex under an upward load imparted by carrier beams 17. The flexing of the cross-member imparted by the carrier beams will aid in bending the inverted steel sections away from a cast beam to break the bond between the form and the concrete when the forms are raised.

As shown in FIG. 3 inner pan units 30 of a pan deck fill the void between adjacent beams to be cast. These inner pan units are preferably fabricated in modular units and are of a size to be carried by a standard truck bed. These inner pan units are preferably stackable and on the order of 5' by 16' with the 5' width being oriented towards efficient vertical movement by workmen. The edge pan units 31 forming the edges of the pan deck around the perimeter of a floor may be specially fabricated for a particular building construction since they are usually somewhat longer than the inner pan units. These edge pan units as well as the inner pan units are connected together in the same manner by the top and lower joists as explained heretofor.

Climbing jacks 20 are connected to the carrier beams 17 by yokes 21 and engage with jack shafts 22 which extend through the pan units. The shafts 22 are supported on their bottom ends either by engagement with a lower floor slab or by engagement with the ground at ground level. The climbing jacks provide the means by which the integral pan deck may be raised. As shown in FIG. 2 each pan unit has at least one jack connected therewith and the jack rods are connected together in groups of four by bracing 23 which in turn is connected to columns 40 cast between floors. This arrangement provides a rigid structure for supporting and raising the integral pan decks.

The column forms comprise disposable cardboard tubes 41 held in place by steel framework. The framework in turn comprises four vertical posts 42 each rigidly connected at one end to a pan unit. The posts are connected at their tops and bottoms by collars 43 which hold a cardboard tube in position. Additional framework 44 connects the posts to the pan units and aids in maintaining alignment of the posts with respect to the pan units. The collars 43 are equipped with locking devices, not shown, which hold the cardboard tube form in place and where the locking devices would include a set of squeezing clamps to bite slightly into the cardboard surface of the tube to hold it securely in place.

The optimum size of the columns is usually on the order of 12 inches to 24 inches in diameter depending on structural requirements. For example, columns at the sides of a building or at upper floor levels may have a smaller diameter than inside columns or columns at lower floor levels since the load carrying requirements are less. Our construction allows pan units and column form framework to be utilized with columns of different diameters since only the locking device of the collar must be changed which further increases efficiency in multi-floor construction.

The integral pan deck is equipped with a lower working deck 50 suspended by hangers 51 from the pan deck to allow workmen access to the bottom joists and to position the bottom panels, shoring, jack rods and braces without the need for separate scaffolding. The work deck will be raised with the integral pan deck thus being in a position at all times for easy access to the underside of the pan deck.

As shown in FIG. 1, the bottom panels 3 which form the bottom of the beam forms are supported by shores 4 which in turn engage and rest upon the cast beams of a lower floor level. The bottom panels 3 and shores 4 are positioned after the pan deck has been raised to an upper floor level and remain in place until such time that newly cast beams have sufficiently hardened. New bottom panels and shoring must be provided when the pan deck is raised to the upper floor level.

A further embodiment of the bottom panel construction is shown in FIGS. 3 and 4. The bottom panels 60 comprise a plurality of segmented pieces 61 each of which is pivoted at one end by hinge member 62 to the bottom of side 2 of a pan unit. The piece 61 is adapted to be clamped or locked by locking means 63 to the side 2 of the adjacent pan unit. A shore head 64 is positioned between the segmented pieces and held in position by a shore 4. When an integral pan deck utilizing this construction is raised, the locking means 63 is unlocked allowing the segmented piece to swing down. The shore head portion and shore remain in place as the deck is raised to supply a support to the cast beam. New shore heads and shores are provided after the deck has been raised to an upper floor level.

In order to complete the structural frame after floor beams have been cast and the pan deck raised, a floor slab must be placed over the top of the beams to span the void between the beams. This may be done by positioning a form into each void between the beams, placing flat sheets of reinforcing mesh into the forms, attaching a slab stop form to the perimeter and at openings through the slab and then casting the concrete slab. The void form work may comprise a removable and reusable form or a disposable leave-in cardboard liner with removable support units. As the floor slab will be installed prior to removing the shoring and the jack rods, crushable devices 70 are added to the rod sides and crushable devices 71 to the shore ends to allow for removal of the rods and shores from the slab after it has been cast. The crushable device may comprise cups surrounding the rod and shore ends made of an easily deformable material, as for example, polystyrene. The voids left in the slabs by the removal of the crushable devices may be spot-filled at a later time.

Beams are reinforced by placing pre-tied cages 80 into the forms as the pan deck is being raised from one floor to the next and after the top joists have been removed. During the lifting operation or when the pan deck reaches the second floor level, the cardboard tubes for the column forms are positioned and pre-tied cages placed within the tubes. Splice bars are then installed between the beam reinforcing cages below the columns after which concrete may be cast into the column forms and into the beam forms.

The method of construction is as follows. The pan deck units are initially assembled together at the foundation level to form a pan deck with the facing sides of adjacent pan units defining vertical sides of a beam to be cast. The pan units are locked or clamped together on their topsides by top joists such that the pan units are locked together to make an integral pan deck. At the same time cardboard tubes are positioned within the column holder frames and reinforcing cages added to the column forms. Concrete is then cast into the column forms. After the concrete has been cast into the column forms, the pan deck is lifted to a point where the lower working platform 50 can be initially installed. Bottom panels are positioned between the adjacent pan units and the pan units are locked or clamped together on their undersides by bottom joists. The top joists are then removed and reinforcing cages are added to the beam forms. After the lower working platform is installed the pan deck is lifted to the level of the first supported floor. At the same time cardboard tubes are positioned within the column holder frames and reinforcing cages added to the columns and to the beam forms. After the pan deck has reached the level of the first supported floor, the shores are positioned below the bottom panels. Reinforcing splice bars are positioned in the beams below the columns, jack rod bracing is installed and the concrete is cast in the beams and columns.

After the concrete has hardened, the bottom joists are removed and the integral pan deck raised by the jack means leaving a portion of the bottom panels in place supported by shoring. After the pan deck has cleared the cast beams on the first floor level, the bottom panels are reapplied and the bottom joists are reapplied to lock the pan units together after which the top joists are then removed. While the pan deck is being raised, cardboard tubes are positioned within the column frames and reinforcing cages added to the column and beam forms in the manner described previously. After the pan deck has reached the second supported floor level, splicing bars are positioned in the beams below the columns, the jack rod bracings installed and the concrete cast as outlined previously. This procedure is continued through as many multiple floors as required for the building.

An advantage of the aforementioned method of construction is that material handling is considerably reduced. This is because it is not necessary to utilize a conventional hoist to raise framework from one floor level to a further floor level as is usually done. The only material which must be transported from ground level to the floor level being constructed is the concrete reinforcing steel and cardboard forms. This can be done by utilizing a skip hoist for carrying concrete to the working deck. From the skip hoist deposit point, a boom equipped with concrete pumps may be used to place the concrete in the beams and columns. The reinforcing framework or cages may be handled by ground cranes or even light cranes mounted on the integral pan deck. Column tube forms can likewise be lifted from the ground and stored on the integral pan deck.

It is apparent that a method and construction according to the invention will materially speed up multi-floored concrete construction while at the same time reducing expense associated with moving forms from one floor level to another floor level.

We claim:

1. Multi-floor concrete construction process including casting concrete floor beams at vertically spaced floor levels comprising the steps of:

(a) assembling a plurality of horizontally spaced pan form units together at a first floor level to form a pan deck wherein facing sides of adjacent pan form units define vertical extending sides of a beam form;

(b) positioning a removable bottom panel between adjacent pan form units to define the bottom of a beam form;

(c) connecting adjacent pan form units together by means of horizontally extending bottom joists clamped to the underside of said pan form units to form an integral pan deck;

(d) casting concrete into the beam form;

(e) connecting adjacent pan form units together by means of horizontally extending top joists clamped to the top side of said pan form units to form an integral pan deck;

(f) allowing the concrete in said beam form to harden to form a cast beam at a first floor level;

(g) unclamping the bottom joists from the underside of said pan form units;

(h) removing said removable bottom panel from between said pan form units;

(i) vertically raising said pan form units together as a single integral pan deck to a second floor level;

(j) repositioning a removable pottom panel between said pan units to define a bottom side of a beam form of a second floor level; and (k) reconnecting adjacent pan form units together by means of horizontally extending bottom joists clamped to the underside of the pan form units after the integral pan deck has been raised above the cast beam of the first floor level.

2. A process according to claim 1 including the additional step of adding a reinforcing framework into a beam form prior to casting concrete therein.

3. A process according to claim 1 including the additional step of unclamping the horizontally extending top joists from the top side of the pan form units after the horizontally extending bottom joists have been reclamped to the underside of the adjacent pan form units.

4. A process according to claim 1 including the additional step of positioning a column form to extend vertically above the pan deck at the first floor level.

5. A process according to claim 4 including the additional step of casting concrete into the column form during the same step that the concrete is cast into the beam form at the first floor level.

6. A process according to claim 1 including the additional step of adding a floor slab over the beams of the first floor level to span the void between adjacent beams after said pan deck has been raised to the second floor level.

* * * * *